United States Patent [19]

Perez

[11] 4,128,911

[45] Dec. 12, 1978

[54] COMPOUND MANUAL TOOTHBRUSH

[76] Inventor: Africa P. Perez, 199 McAllister Rd., Downsview, Toronto, Ontario, Canada, M3H 2P1

[21] Appl. No.: 806,554

[22] Filed: Jun. 14, 1977

[30] Foreign Application Priority Data

Jul. 9, 1976 [CA] Canada ..... 256724

[51] Int. Cl.[2] ..... A46B 9/04

[52] U.S. Cl. ..... 15/167 R

[58] Field of Search ..... 15/167 R, 167 A, 201, 15/202

[56] References Cited

U.S. PATENT DOCUMENTS

| | | | |
|---|---|---|---|
| 1,885,950 | 11/1932 | Sandig | 15/167 R X |
| 2,232,269 | 2/1941 | Reuben | 15/167 R X |
| 2,435,394 | 2/1948 | Hawley | 15/167 R X |

*Primary Examiner*—Edward J. McCarthy

[57] ABSTRACT

Common toothbrushes are known as simple units designed for simple use. In this invention, a compound toothbrush is formed by two distinct toothbrushes, one of which closely fits within the partially hollow frontage of the other such that both brushes together compose one single toothbrush of common type for regular use, and they may be manually disassembled for separate use of the inner and specially designed brush to efficiently and safely cleanse the crevice between gums and teeth. This compound type of toothbrush also provides additional facilities for alternate and appropriate use of the two brushes for dental cleaning after light meals and snacks, etc., as well as for thoroughly cleaning both brushes after their use by brushing each other.

2 Claims, 3 Drawing Figures

COMPOUND MANUAL TOOTHBRUSH

This invention relates to dental brushes.

Common toothbrushes, while effective and necessary to brush the sides and biting surfaces of the teeth, are less efficient and often unsafe for the essential practice of cleansing the crevice between gums and teeth. To correct this deficiency, a complementary type of toothbrush has been made, specifically designed to brush under the gum line, but as one single, separate toothbrush, and to be used along with a regular brush. It is, however, generally inconvenient to have two toothbrushes for individual use, specially in families of several members, children, etc. Therefore, and as a result, the beneficial practice of using two different types of toothbrush is seldom practised in personal dental care.

I have found that this disadvantage may be overcome by a compound type of manual toothbrush constituted by two distinct toothbrushes, one of which, having its head just wide enough to contain one or two thin and short rows of special bristles, closely fits within the partially hollow frontage of the other toothbrush such that both brushes may be manually assembled together composing one single toothbrush of common type for regular use. The so-composed toothbrush may be also manually disassembled to brush with the special brush under the gum line, as well as for alternate use, by pushing out a fingertip-size prominence which slightly protrudes from the backside of the enclosed brush and shows through a matching orifice. This compound brush also provides two additional and important advantages over simple toothbrushes, as follows: a) the ability to use, after light meals, snacks, etc., the special toothbrush only, thus letting the other brush dry out thoroughly to regain original stiffness so that it will more efficiently brush the tooth surfaces when fully brushing; b) both brushes can be effectively cleaned after using them by brushing each other, thus eliminating accumulation of tiny food particles and bacteria in-between the bristles.

In drawings which illustrate embodiments of the invention,

Figure 1:
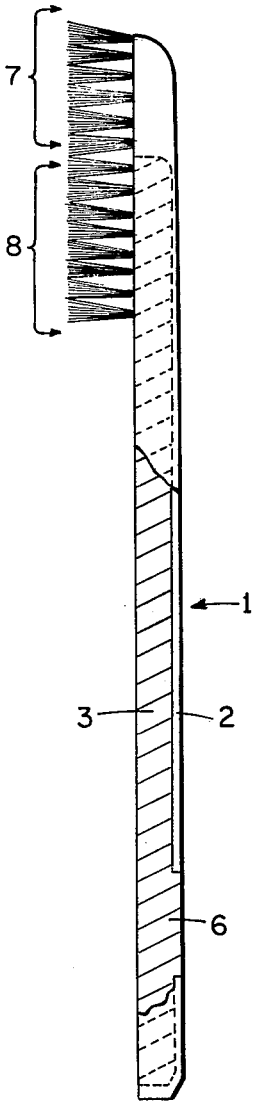
FIG. 1 is a longitudinal plan view partly in section of one embodiment.
Figure 2:
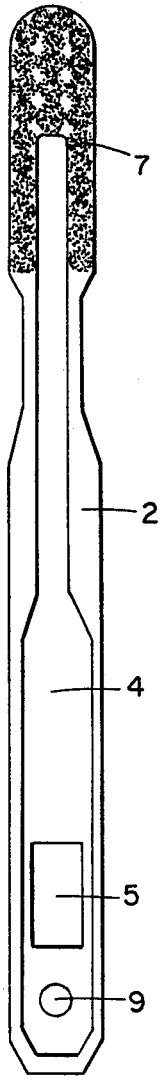
FIG. 2 is a front plan view of part 2 of FIG. 1.

The compound manual toothbrush 1 illustrated comprises two distinct toothbrushes 2–3 assembled together. The outer toothbrush 2 has its frontage partly hollow 4 so as to conform and closely contain the inner toothbrush 3 so that both toothbrushes 2–3 may be assembled together 1 by manually inserting the smaller toothbrush 3 into the matching hollowness 4 of the outer toothbrush 2.

An orifice 5 of fingertip size is open near the end of the handle of the main toothbrush 2 for the purpose of disassemblage and where a matching prominence 6 slightly protruding from the backside 6 of the toothbrush 3 fits within and shows through, more or less at the level of the surrounding surface as shown 6 in FIG. 1, so that it can be readily pushed out with a finger-tip. The hole 9 in both brushes 2–3 is designed for hanging purposes.

Figure 3:
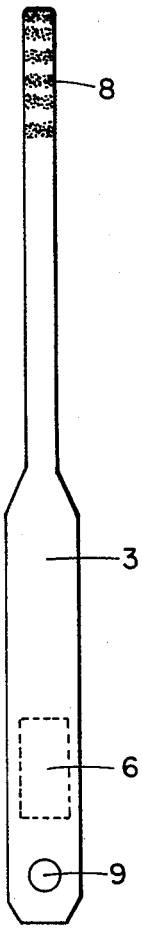
FIG. 3 is a front plan view of part 3 of FIG. 1.

The shape of the inner toothbrush 3 may slightly vary from that shown in FIG. 3, depending on the specific type of brush, consequently the hollowness 4 will be shaped accordingly. The bristles 7 of the outer brush 2 are of different texture and differently tufted than the bristles 8 of the inner toothbrush 3 which are arranged in one or two thin and short rows of soft and specially processed bristles on a narrow head just wide enough to contain them.

While the invention has been described in connection with a particular form and disposition of the parts, it will be appreciated that various modifications and changes may be made without departing from the spirit and scope of the appended claims.

What I claim as new and desire to secure by United States Letters Patent is:

1. A compound toothbrush comprising first and second toothbrushes, said first and second toothbrushes each having a bristled head portion and a handle portion, the second toothbrush in its entire length, or substantial portion thereof, being adapted to fit in a groove in the first toothbrush in readily assemblable and disassemblable relationship for conjunct or separate use, said groove in the first toothbrush longitudinally extending within the bristled side of its head and handle portion, the length, width and depth of the groove corresponding to the length, width and thickness of the second toothbrush, or to that of its portion adapted to fit in the groove, such that said first and second toothbrushes firmly hold together when assembled, the brush head portion of the second toothbrush being narrow both in shape and bristling pattern such as it may be suitable to users for brushing under the gum line, the brush head portions of the first and second toothbrushes forming a single compound brush head portion when assembled for conjunct use.

2. A compound toothbrush comprising first and second toothbrushes, said first and second toothbrushes each having a bristled head portion and a handle portion, the second toothbrush in its entire length, or substantial portion thereof, being adapted to fit in a groove in the first toothbrush in readily assemblable and disassemblable relationship for conjunct or separate use, said groove in the first toothbrush longitudinally extending within the bristled side of its head and handle portion, the length, width and depth of the groove corresponding to the length, width and thickness of the second toothbrush, or to that of its portion adapted to fit in the groove, such that said first and second toothbrushes firmly hold together when assembled, the brush head portion of the second toothbrush being narrow both in shape and bristling pattern such as it may be suitable to users for brushing under the gum line, the brush head portions of the first and second toothbrushes forming a single compound brush head portion when assembled for conjunct use, the first toothbrush containing an aperture in the grooved portion of its handle, said aperture being shaped and sized such that a fingertip may have access into it and show through, and the second toothbrush having a prominence slightly protruding from the backside of its handle, said prominence shaped to fit within the aperture in the handle of the first toothbrush and in substantial evenness show through it.

* * * * *